US005398462A

United States Patent [19]

Berlin et al.

[11] Patent Number: 5,398,462

[45] Date of Patent: Mar. 21, 1995

[54] ACTIVELY CONTROLLED STRUCTURE AND METHOD

[75] Inventors: Andrew A. Berlin, Monsey, N.Y.; Gerald J. Sussman, Arlington, Mass.

[73] Assignee: Massachusetts Institute of Technology, Cambridge, Mass.

[21] Appl. No.: 851,745

[22] Filed: Mar. 16, 1992

[51] Int. Cl.[6] ..... E04C 3/30

[52] U.S. Cl. ..... 52/1; 52/720; 52/741.1

[58] Field of Search ..... 73/862, 632, 862.637, 73/862.68, 862.451, 786; 52/1, 167 R, 167 DF, 741.1, 720; 318/127

[56] References Cited

U.S. PATENT DOCUMENTS

| | | | |
|---|---|---|---|
| 4,320,602 | 3/1982 | Richardson | 52/1 |
| 4,635,892 | 1/1987 | Baker | 52/167 DF |
| 4,841,685 | 6/1989 | Masri et al. | 52/1 |
| 4,956,947 | 9/1990 | Middleton | 52/167 DF |
| 5,046,290 | 9/1991 | Ishit et al. | 52/1 |
| 5,107,634 | 4/1992 | Onoda et al. | 52/167 DF |
| 5,168,673 | 12/1992 | Nemir et al. | 52/1 |

OTHER PUBLICATIONS

"Feedback Control of the Buckling Instability in an Axially Compressed Thin Elastic Beam" by Raymond P. Jefferis 1968 UPenn Ph.D. thesis.

William Zuk and Roger Clark, "Kinetic Architecture", Van Nostrand Reinhold, N.Y., 1970, pp. 34–45 (especially pp. 40–44).

W. Zuk, "The Past and Future of Active Structural Control Systems". Pp. 779–794 in Structural Control by Leipholz (editor), 1980, North-Holland SM Publications.

Hirsch, G., "Critical Comparison between active and passive control of wind induced vibrations of structures by means of mechanical devices", pp. 313–339 (especially pp. 332–335) in *Structural Control* (which is cited above).

Su, Y. and Tadjbaksh, I., "Optimal control of beams with dynamic loading and buckling", Joint applied mechanics/bioengineering conference, Transactions of the ASME, Journal of Applied Mechanics, Mar. 1991 (vol. 58), pp. 197–202.

Chaudhry, Z. and Rogers, C., "Bending and shape control of beams using SMA actuators", Journal of Intelligent Material Systems and Structures, v 2 n 4, Oct. 1991, pp. 581–602.

A. Baz et al., "Active Control of Buckling of Flexible Beams", Catholic University of America, Washington, D.C., 1989, pp. 211–218 (received directly from the author by applicant). Available as NASA-CR-183333.

A. Baz et al., "Control of Smart Traversing Beams", pp. 901–910, ASME Conf. on Active Materials and Adaptive Structures, 1992 by IOP Publishing Ltd.

Soong, T. T., "Active Structural Control: Theory and Practice", Wiley & Sons, N.Y. 1990, pp. 5–9 (this book surveys the field of active control of structures).

A. Baz, et al., "Active buckling control of nitinol-reinforced composite beams", pp. 167–176, ASME Conf. on Active Materials and Adaptive Structures, 1992 by IOP Publishing Ltd.

*Primary Examiner*—Carl D. Friedman
*Assistant Examiner*—Robert J. Canfield
*Attorney, Agent, or Firm*—Testa, Hurwitz & Thibeault

[57] ABSTRACT

Apparatus and method for increasing the compressive strength of a beam loaded in compression. A sensor is responsive to shape changes of the loaded beam, and an actuator responsive to the sensor is constructed to apply a force to counteract the bending of the beam.

11 Claims, 2 Drawing Sheets

ACTIVELY CONTROLLED STRUCTURE AND METHOD

This invention was made with government support under contract number N00014-89-J-3202 awarded by the Navy. The government has certain rights in the invention.

BACKGROUND OF THE INVENTION

The invention relates to actively controlled structures and in particular to active control of buckling in beams or columns loaded in compression.

For many physical geometries, buckling is a factor limiting the maximum compressive force that may safely be applied to a member. Indeed, for many long slender members, the strength limitation imposed by buckling is several orders of magnitude more important than other factors limiting the loading of the member, such as plastic deformation.

Previous work in active control as it relates to beams and columns has included vibration control for application to large space structures. In particular, one group at MIT has done much work involving the use of piezoelectric actuators to damp out various vibration modes.

Other work has been done at Catholic University in Washington, D.C. As an axial load on a column is increased, bending begins. At about a quarter of the buckling load, this bending becomes quite noticeable. One part of the Catholic University work involves sensing when this bending begins and using Nitinol actuators to reduce the load on the column, thereby preventing the onset of significant bending and preventing buckling of the column. This work appears to make complex structures more robust by shifting weight to other supporting members when one member becomes overloaded.

Another aspect of this work involves the use of Nitinol shape memory wires, embedded within a beam, to control the beam's curvature. This work seems to be aimed at adaptive structure applications, in which it is desirable for a single beam to take on different shapes during different stages in the construction process. For instance, when constructing a long bridge out of smaller segments, actuators can arrange for the bridge segments to arch upwards, both to correct for differences in height between the two land masses being joined by the bridge, and to correct for bending caused by heavy loads crossing the bridge itself.

This nitinol wire approach has also been used to forcibly correct the bending that arises when a beam is axially loaded. It allows the beam to bend as the load approaches (but does not exceed) the buckling mode, and then uses the nitinol wires to stiffen the beam (on a time scale of 3–4 seconds) such that it takes on the desired shape.

SUMMARY OF THE INVENTION

In general, the invention features increasing the compressive strength of a beam loaded in compression. Briefly, one or more sensors are responsive to shape changes of the loaded beam, and one or more actuators responsive to the sensor are constructed to apply a force to counteract the bending of the beam.

Actively controlled structures, according to the invention, are advantageous in that they may be loaded to levels well in excess of levels that would otherwise cause catastrophic buckling of the structure. These structures may therefore be lighter, stronger and/or less expensive. Structures of this type may not require provisions for shifting weight as the strength of the beam is permanently increased. As axially loaded members find wide application in a variety of structures, the technique of the invention has the potential both to reduce the amount of material a structure requires, and to increase the structure's load bearing capability.

DESCRIPTION

Figure 1:
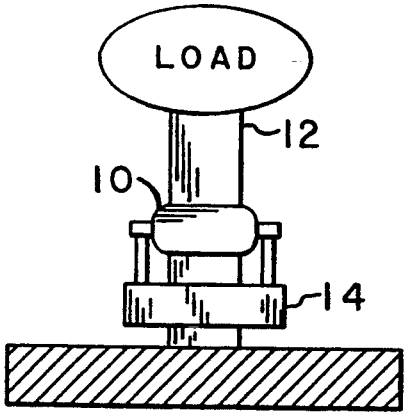
FIG. 1 is a diagram of an actively controlled column.

Theoretically, a perfectly uniform, straight column subjected to a large, perfectly centered axial load will not buckle because it is in perfect equilibrium. In a sense, the column does not buckle because it is perfectly balanced and can not decide which direction to buckle towards. Unfortunately, this state is unstable—even the slightest perturbation in the load or the slightest imperfection in the column will lead immediately to buckling. From a structural engineering point of view, this instability renders the column useless under heavy loads, since in the real world beams are not perfectly uniform, and loads are not perfectly axial or perfectly centered.

The invention involves the use of active control to stabilize the otherwise unstable equilibrium condition associated with a beam being perfectly straight and under a perfectly centered axial load. When an external perturbation or material imperfection leads to the onset of buckling, this is measured by sensors. Actuators are then used to push the beam back towards its equilibrium position.

In this method, the onset of buckling is detected very early, while the beam is still very close to its equilibrium position. With the beam nearly at equilibrium, a very small force can be used to push the beam back towards the equilibrium position, effectively altering the direction in which the buckling will occur. By repeating this process of using very small forces to return the beam to the equilibrium position, what would normally be a catastrophic structural failure is reduced to a small oscillation of the beam about its equilibrium point.

In typical use, a sensor and actuator combination will play the role of a virtual brace. Placed at the midpoint of a column, the actuator effectively divides the long column into two smaller columns, each of which is half the length of the original. Since buckling strength increases as the square of the column length, the overall strength of the braced member increases by a factor of four. This corresponds to the elimination of the first buckling mode.

This technique can be applied repeatedly, with two additional sensor/actuator combinations being used to form two virtual braces, to be placed at the midpoint of each of the two half-length members that remain after cancellation of the first buckling mode. In this way, the second buckling mode can be cancelled, resulting in an overall buckling strength increase of a factor of 16. This technique may also be applied simultaneously in two dimensions, preventing buckling in any direction. Furthermore, extra actuators may be used for other purposes, such as to compensate for non-axial loading, such as wind loading.

There are considerations in this repeated application of the method. In some instances, only a few buckling modes can be meaningfully cancelled before material properties other than the buckling load become the factor limiting the overall strength of the member. As this approach is applied repeatedly N times, the effective length of each sub-member decreases by a factor of $2^N$, resulting in short column segments. Stabilizing the equilibrium position of these short columns requires the use of greater actuator force than is required for stabilizing long columns. Alternatively, the onset of buckling will need to be reacted to sooner in short columns, before the angular deflection grows to the point where excessive actuator force is required. Additionally, as the number of actuators grows and the effective column lengths grow shorter, the interaction between the various actuators may become significant, and the beam segments may no longer appear to be approximately axially loaded.

Overall, the number of times this technique can be applied (and hence the overall strength increase attainable) will vary both with material type and geometry, and with the set of stresses and potential external perturbations that a particular structure will undergo. However, even if the approach is only used once or twice on a long member, the effect of a factor of four or 16 increase in strength is very significant.

The virtual bracing techniques can be realized using a variety of structural approaches. Referring to FIG. 1, one approach is to fasten a motive element 10 such as a linear induction motor to the midpoint of the column 12. A sensor such as a strain gage is used to measure the deflection of the midpoint of the column (see sensor 32 on FIG. 3). When the sensor indicates that buckling is starting, the motor applies a force that opposes the buckling motion. This force can be generated by accelerating a reaction mass 14. The reaction mass approach is attractive in that it allows a control force to be applied without relying on any other members or ground-based anchors for support.

Asymmetry may limit the effectiveness of the reaction-mass based approach in that an unfortunate sequence of unidirectional perturbations could cause the reaction mass to reach the physical limit of its motion. This can be overcome to some extent by having the motor over-react to perturbations, such that the beam starts to buckle in the opposite direction, giving the reaction mass time to return to the center of its motion range. Nevertheless, it may prove desirable to supplement the reaction-mass force with a method of applying a constant force to the center of the column to correct for asymmetries.

Figure 2:
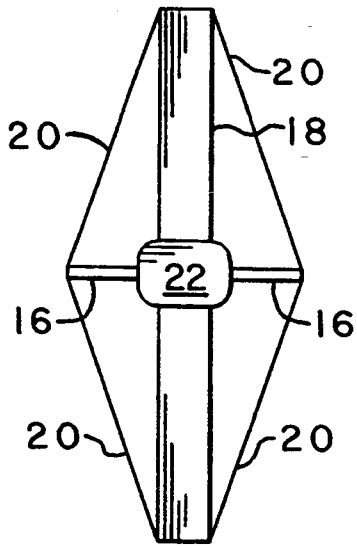
FIG. 2 is a diagram of an alternative embodiment of an actively controlled column.

An alternative approach is the use of a set of tendons arranged in a configuration that resembles a boat mast, as shown in FIG. 2. In this configuration, a small beam 16 (the 'yard') is mounted perpendicular to the long column 18. Tendons 20 such as guy wires anchored to the top and bottom of the column are attached to the yard. When buckling is detected, an actuator 22 moves the yard relative to the center of the column. Since the tendons apply forces that resist the motion of the yard, it is the column itself that moves, thereby countering the buckling motion. This approach has a significant advantage over the inertial mass approach in that it is capable of applying a constant force to the beam in order to counter asymmetries (e.g., due to wind loading). Additional material is generally required to form the yard, however, and the forces exerted by the tendons may vary the compressive load applied to the beam.

The active control technique may also be applied to the problem of a boat mast resisting bending caused by wind forces. In the boat mast, the sole force resisting bending is the tension in the tendons. As a result, a relatively long yard must be used in order for a significant component of this force to be directed in the horizontal direction to resist bending. Furthermore, the tension in each tendon must be sufficient to both counter the forces exerted by the other tendon, and to resist the bending motion of the column. By utilizing a 'smart yard' that actively pushes on the appropriate tendon to counter bending, it is feasible to use a much shorter (hence lighter) yard. The unidirectional force applied by the 'smart yard' would also reduce the need for simultaneous large tension in both tendons, as each tendon would no longer be resisting the forces exerted by the other.

Figure 3:
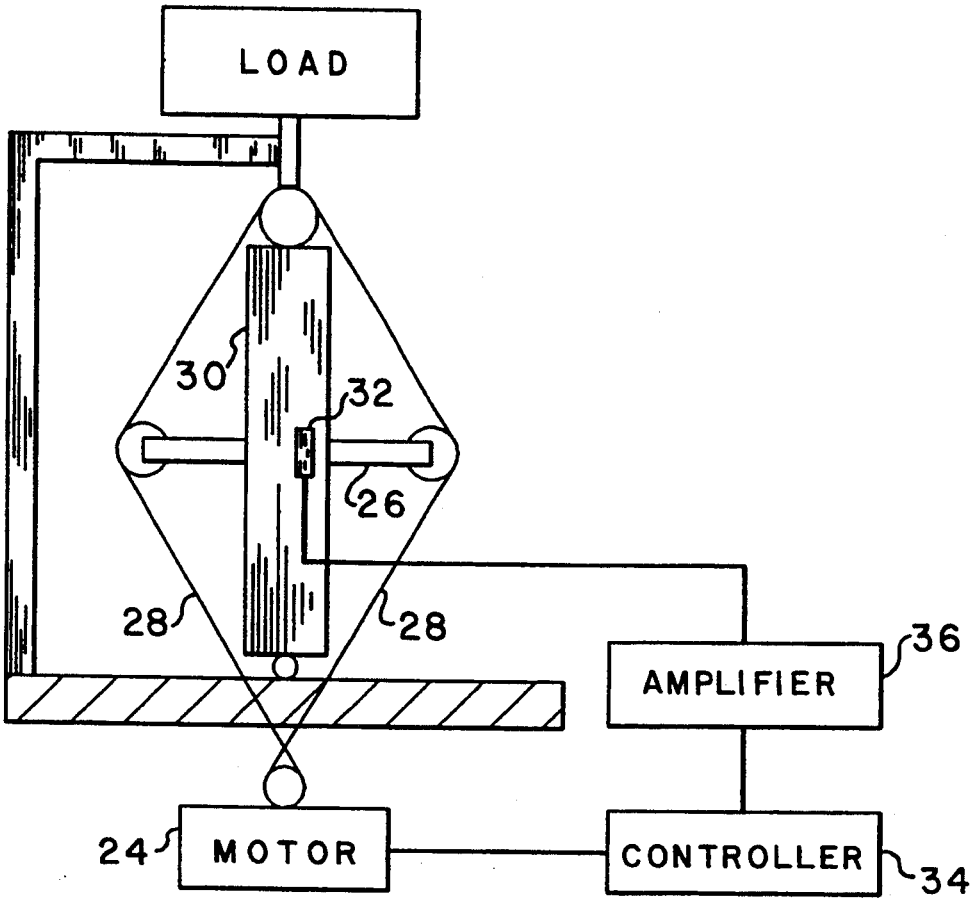
FIG. 3 is a diagram of another alternative embodiment of an actively controlled column.

The active control technique can be applied to many variations of the structures described above. Referring to FIG. 3, for instance, in the tendon approach, rather than mounting the motor 24 on the yard 26 itself, the motor could be located remotely. Buckling would be resisted by varying the relative tension between the two tendons 28, rather than by moving the yard relative to the column 30. The imbalance in the tension of the tendons engaging the yard would lead to a net horizontal force being applied to the yard, which in turn would counter the buckling motion of the beam. Other possibilities include the use of compressed gas or water jets to apply force to the center of the beam.

For the inertial mass approach, linear induction motors can provide large actuation forces in a compact package. These linear motors are well suited for the inertial mass approach. For the active yard approach, hydraulic motive elements have the ability to provide a constant force with no power drain, which is useful for countering asymmetries. Hydraulics have the further advantage that the pressure source may be located remotely, permitting a relatively lightweight, yet powerful actuator to be mounted on the column itself. Many other motive element types, such as DC motors, are readily available and usable. Sensors to track the motion of a beam or column are also readily available, such as strain gages and piezoelectric sensors, which may be mounted directly on a beam. In addition, various fiber-optic and laser based sensing devices may be used.

This technique may be accomplished by constructing an active column, as illustrated in FIG. 3, using a variant of the tendon/yard based approach described earlier. A set of strain gages may be used to measure curvature of the beam, thereby detecting the onset of buckling. The strain gage signal may be amplified (36), and then transmitted to a controller 34. The controller determines the appropriate reaction force required to counteract the buckling motion, and then applies this force to the beam. The actuator may be a permanent magnet electrical motor, which applies a torque that varies the relative tension between the two tendons, thereby applying a net horizontal force to the midpoint of the column.

One demonstrative embodiment may be constructed of a 12 inch long, 2 inch wide piece of very thin steel (0.010 inches). The controller may be implemented using a programmable computer equipped with an analog interface card that allows it to sense and respond to beam motion in real time. The use of the computer allows fast experimentation with different control strategies. The controller may be implemented as single chip analog circuit, or as a single chip microprocessor with an analog interface.

A variety of control algorithms may be used to allow the beam to be loaded above its critical buckling load. Proper control design can allow the actuator to be constructed to modulate the actuating force on a time scale that is sufficiently small to allow it to be less than approximately 100 times smaller than the loading force and still prevent significant loss of loading strength or catastrophic failure. For many smaller beams, the actuator will be required to modulate the force on a time scale on the order of hundredths of a second.

Figure 4:
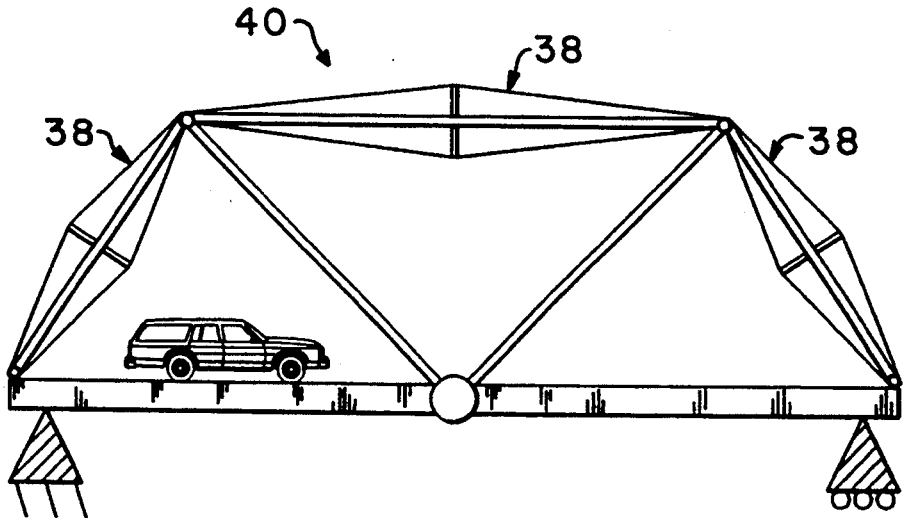
FIG. 4 is an illustration of an actively controlled truss bridge.

The applications of this work may be quite widespread. Many bridges are composed of trusses, such that the length of the bridge is limited by the buckling resistance of a beam subjected to axial loading. FIG. 4 illustrates how this technology may be applied to a truss bridge 40, producing a bridge that is both stronger and lighter than would otherwise be possible. This bridge, composed of "Smart Beams," 38 may be strengthened by using active control to increase the buckling strength of compressively loaded members. Vibration control actuators may be employed to prevent undesirable interactions between the active beams in such a structure.

Other applications include making boat masts with active yard's that are both shorter and lighter, and earthquake engineering applications in which certain members must be strong at certain times, but allowed to flex and buckle at other times. Structures subjected to sudden compressive loading, such as airplane landing gear, could also be strengthened by this technology.

Certain types of ship designs have a compressively loaded beam running the entire length of the ship. When subjected to the periodic excitation of wave action, this beam buckles slightly, eventually leading to failure. Active control could be used to apply force to the midpoint of this column, thereby countering the buckling effect of the wave action, increasing the life of the beam.

Other modifications and implementations will occur to those skilled in the art without departing from the spirit and the scope of the invention as claimed. Accordingly, the invention is to be defined not by the proceeding illustrative description, but by the following claims.

What is claimed is:

1. Apparatus for inhibiting buckling of a beam loaded in compression, comprising:

a sensor responsive to shape changes of a beam due to an axial compressive load on the beam capable of causing the beam to buckle, a yard coupled to the beam, and an actuator for applying, in response to an indication from said sensor, a force to said yard to counteract shape changes of the beam due to the axial compressive load, thereby inhibiting buckling of the beam.

2. The apparatus of claim 1 wherein said actuator includes tendons engaging said yard, and a motive element movably coupling said yard to the beam to allow movement of said yard with respect to the beam in response to an indication from said sensor thereby applying the counteracting force.

3. The apparatus of claim 1 wherein said yard is fixedly attached to the beam, and wherein said actuator includes a tendon engaging said yard, and a motive element engaging said tendon to adjust tension in said tendon in response to an indication from said sensor thereby applying the counteracting force.

4. A beam comprising:

a beam member having first and second beam ends, said beam being loaded in compression due to a force that loads said beam past the point where buckling would occur without compensation, the force being applied at each of said beam ends, a sensor mounted to said beam at a position along said beam between said ends, said sensor being responsive to bending of said beam, a yard having first and second yard ends, said yard being attached between said first and second yard ends to said beam at a location proximate said sensor, a tendon anchored at said first end of said beam and engaging said first and second yard ends, and a motive element engaging said tendon and being responsive to said sensor to adjust tension in said tendon to apply a force to counteract bending of said beam in response to an indication from said sensor.

5. The beam of claim 4 wherein the counteracting force is less than approximately 100 times smaller than the force that loads said beam past the point where buckling would occur without compensation.

6. The beam of claim 4 wherein said motive element is mounted at the second end of said beam.

7. A method of inhibiting buckling of a beam loaded in compression, comprising:

detecting deformations of a beam due to an axial compressive load capable of causing the beam to buckle, and moving a reaction mass, which is mounted movably with respect to the beam, in response to the detection of deformations thereby applying a force to the beam to counteract the detected deformations and inhibit buckling of the beam.

8. Apparatus for inhibiting buckling, comprising:

a beam loaded in compression by an axial force that is capable of causing the beam to buckle;

a piezoelectric sensor coupled to the beam and responsive to shape changes of the beam due to the axial force loading the beam; and an actuator applying, in response to an indication by the piezoelectric sensor, a force to the beam to counteract the shape changes of the beam due to the axial force loading the beam, thereby inhibiting buckling of the beam.

9. The apparatus of claim 8 wherein the counteracting force applied by the actuator is about 100 times smaller than the axial force loading the beam.

10. Apparatus for inhibiting buckling, comprising:

a beam loaded in compression by an axial force that is capable of causing the beam to buckle;

a strain sensor coupled to the beam and responsive to shape changes of the beam due to the axial force loading the beam; and an actuator applying, in response to an indication by the strain gage sensor, a force to the beam to counteract the shape changes of the beam due to the axial force loading the beam, thereby inhibiting buckling of the beam.

11. The apparatus of claim 10 wherein the counteracting force applied by the actuator is about 100 times smaller than the axial force loading the beam.

* * * * *